US007905713B2

(12) United States Patent
Hofmann et al.

(10) Patent No.: US 7,905,713 B2
(45) Date of Patent: Mar. 15, 2011

(54) METHOD OF OPERATION OF A RECIPROCATING POSITIVE-DISPLACEMENT PUMP AND RECIPROCATING POSITIVE-DISPLACEMENT PUMP

(75) Inventors: Frank Hofmann, Hamburg (DE); Egbert Junge, Rosengarten (DE)

(73) Assignee: Hofmann GmbH Maschinenfabrik und Vertieb, Rellingen (DE)

( * ) Notice: Subject to any disclaimer, the term of this patent is extended or adjusted under 35 U.S.C. 154(b) by 769 days.

(21) Appl. No.: 11/732,063

(22) Filed: Apr. 2, 2007

(65) Prior Publication Data

US 2008/0014106 A1 Jan. 17, 2008

(30) Foreign Application Priority Data

Apr. 3, 2006 (DE) ..... 10 2006 015 845

(51) Int. Cl.
*F04B 23/04* (2006.01)
*F04B 41/06* (2006.01)

(52) U.S. Cl. ..... 417/521; 417/53; 417/540

(58) Field of Classification Search ..... 417/53, 417/383, 386–388, 521, 529, 540–543
See application file for complete search history.

(56) References Cited

U.S. PATENT DOCUMENTS 2,430,723 A * 11/1947 Lupfer ..... 417/343
2,858,767 A * 11/1958 Smith ..... 417/346
3,816,029 A * 6/1974 Bowen et al. ..... 417/223
4,229,146 A * 10/1980 Errett ..... 417/281
4,359,312 A * 11/1982 Funke et al. ..... 417/18
4,543,044 A * 9/1985 Simmons ..... 417/342
5,129,427 A * 7/1992 White et al. ..... 138/30
5,141,408 A * 8/1992 Conrad et al. ..... 417/339
5,165,869 A * 11/1992 Reynolds ..... 417/385
5,205,326 A * 4/1993 Paley et al. ..... 138/30
5,813,841 A * 9/1998 Sturman ..... 417/446
6,113,368 A 9/2000 Hofmann
6,318,978 B1 * 11/2001 Burns ..... 417/540
6,644,930 B1 * 11/2003 Kuismanen ..... 417/53

FOREIGN PATENT DOCUMENTS

DE 19727623 7/1998

* cited by examiner

*Primary Examiner* — Devon C Kramer
*Assistant Examiner* — Amene S Bayou
(74) *Attorney, Agent, or Firm* — Greer, Burns & Crain, Ltd.

(57) ABSTRACT

A method for operating a reciprocating positive displacement pump for the simultaneous low-pulsation discharge of a plurality of liquids, having for each liquid at least two pump chambers and displacement devices capable of movement therein, of which the one displacement device takes in liquid during the actual discharge phase of the other displacement device, and at the end of its intake stroke reverses its direction of movement, and, in a pre-compression phase, pre-compresses the liquid taken into the associated pump chamber and when a predeterminable pre-compression pressure has been achieved comes to a standstill, and remains at the standstill until the other displacement device has ended its liquid discharge, and, subsequent to this discharge, begins its own discharge. The method includes the steps of carrying out a pressure compensation during the subsequent discharge stroke preventing a pressure compensation between the individual pump chambers during the subsequent discharge stroke.

15 Claims, 6 Drawing Sheets

METHOD OF OPERATION OF A RECIPROCATING POSITIVE-DISPLACEMENT PUMP AND RECIPROCATING POSITIVE-DISPLACEMENT PUMP

BACKGROUND OF THE INVENTION

The present invention relates to a method for operating a reciprocating positive-displacement pump for the simultaneous low-pulsation discharge of a plurality of liquids, having for each liquid at least two pump chambers and displacement devices capable of movement therein, of which the one displacement device takes in liquid during the actual discharge phase of the other displacement device, and reverses its direction of motion at the end of the intake stroke, and, in a pre-compression phase, pre-compresses the liquid taken into the associated pump chamber, and comes to a standstill when a prespecifiable pre-compression pressure is reached, and remains at a standstill until the other displacement device has concluded its liquid discharge, and, subsequent to this discharge, begins its own discharge. Moreover, the present invention relates to a reciprocating positive displacement pump for the simultaneous low-pulsation discharge of a plurality of liquids, having for each liquid at least two pump chambers and displacement devices that are capable of movement therein, of which the one displacement device takes in liquid during the actual discharge phase of the other displacement device, and reverses its direction of motion at the end of the intake stroke, and the liquid taken into the associated pump chamber is pre-compressed in a pre-compression phase and comes to a standstill when a pre-specifiable pre-compression pressure is reached, and remains at a standstill until the other displacement device has concluded its liquid discharge, and subsequent to this discharge begins its own discharge.

In known pumps of this type, the displacement devices for the individual pump chambers are rigidly connected to one another and have a common drive, usually in the form of a hydraulic cylinder.

Extraordinarily low pulsation without the use of what are known as pulsation dampers is achieved by oscillating displacement pumps having two displacement devices for each liquid, of which the one displacement device takes in liquid during the actual discharge phase of the other displacement device, and reverses its direction of motion at the end of the intake stroke, and the liquid taken into the associated pump chamber is pre-compressed in a pre-compression phase and comes to a standstill when a pressure prespecified by the system is reached, and remains at a standstill until the other displacement device has concluded its liquid discharge, and subsequent to this discharge the displacement device that is at a standstill at the end of the pre-compression phase begins its discharge.

In pumps of this type, the hydraulic pressure applied in the hydraulic drive cylinder is controlled for example by a control device according to DE 197 27 623 C1, dependent on the pressure of the current discharge side of the pump, in such a way that the pressure always remains at a safe distance below the pressure of the currently discharge side of the pump, so that liquid outlet valves of the pump chambers cannot open as a result of the higher pressure prevailing in the liquid line to the consumer.

In pumps of this type, as a rule different pre-compression pressures arise in the two discharge cylinders until the opening of one of the outlet valves, and as a rule different pre-compression pressures also occur from one discharge stroke to the next discharge stroke. It is a fairly rare coincidence for the two pre-compression pressures to be equal. The differences in the pre-compression pressures are dependent on different degrees of filling of the pump chambers, differences in viscosity, different tightnesses at the valves, differences in the compressibility of the two liquids that are to be discharged, which for example can already vary strongly from stroke to stroke merely as a result of single air bubbles, and on different degrees of elasticity of the components.

At the end of the pre-compression stroke, the hydraulic piston force of the drive cylinder is in equilibrium with the sum of the two axial forces on the displacement devices. The sum of the two displacement device forces (pre-compression pressure times surface) is always the same; i.e., the missing amount of pre-compression force at the one displacement device is added at the other displacement device. Thus, there is a double effect.

The surface ratio of the two displacement devices has a great influence on the difference in the pre-compression pressures. The greater the surface difference, the faster and farther the pre-compression pressure increases at the displacement device having the smaller surface, due to the small pump chamber volume, above the pre-compression pressure of the pump chamber having the larger-surface displacement device.

The possible pressure difference is greater:

- the greater the surface difference of the displacement devices is,
- the tighter a suction valve of the smaller pump chamber is,
- the less tight a suction valve of the larger pump chamber is,
- the faster the suction valve of the smaller pump chamber closes,
- the slower the suction valve of the larger pump chamber closes,
- the greater the degree of filling of the smaller pump chamber is,
- the lesser the degree of filling of the larger pump chamber is,
- the smaller the volume of the smaller pump chamber is,
- the larger the volume of the larger pump chamber is,
- the less compressible the liquid in the smaller pump chamber is, and
- the more compressible the liquid in the larger pump chamber is.

From the above, it is clear that statements about the size of the differences in the pre-compression pressures are less reliable the greater the differences in the displacement device surfaces, and the greater the differences between the two liquids that are to be discharged. For the sake of simplicity, hereinafter only different degrees of filling will be referred to.

If, given an displacement device surface ratio of 1:1, for example no pre-compression at all is achieved in one of the two pump chambers (e.g. due to insufficient filling or a leaky suction valve), the pre-compression pressure in the other cylinder increases to twice the pressure that would arise given a uniform distribution. If no pre-compression is achieved given an displacement device surface ratio of e.g. 49:1 in the cylinder having the larger displacement device, the pressure in the other cylinder increases to 49 times the pressure.

If the unequally pre-compressed pump chamber fillings of one pump side are connected by lines to the consumer, e.g. a spray gun, at the beginning of the discharge stroke, the discharge of the two liquids begins nonuniformly and with a temporal offset. The discharge cylinder having the higher pressure relative to a consumer line pressure emits, when its pressure relaxes to consumer pressure, a corresponding liquid quantity into the consumer line in pulsed fashion, in addition to the target quantity. The other discharge cylinder, whose pre-compression pressure is lower than the consumer pressure, must first be further compressed to consumer pressure before material is pressed into the consumer line. For this purpose, a displacement device stroke, i.e. time, is required. While the one pump chamber, relative to one pump side, begins with surplus discharge, the discharge from the other pump chamber begins too late, so that at the consumer there is a brief lack of liquid in the insufficiently pre-compressed discharge cylinder.

Therefore, for the present invention the problem arises of removing these disadvantages of discharge flow irregularities of the previous methods and devices, and to create a method and a device of the type indicated above that provide a discharge of the liquids that are to be discharged that is uniform at all times.

SUMMARY OF THE INVENTION

In order to solve the first part of the problem, a method of the type named above is proposed that is characterized in that during the pre-compression phase a pressure compensation is carried out between the individual pump chambers, and during the subsequent discharge stroke a pressure compensation between the individual pump chambers is prevented.

With the method according to the present invention, it is advantageously achieved that different pre-compression pressures are avoided, and that the liquid discharge begins simultaneously and is maintained from all pump chambers at the beginning of the discharge stroke, in quantities corresponding to the displacement device cross-sections.

A first construction provides that, for each liquid to be discharged, pistons that are rigidly connected to a single drive piston transmit their force via a fluid to the displacement device allocated to the respective piston, fluid chambers between the individual pistons and the associated displacement devices being connected to one another during the pre-compression phase and being decoupled from one another during the discharge stroke. The fluid chambers allocated to the displacement devices are therefore interconnected during the pre-compression phase, so that the displacement devices can move relative to one another until pressure equality is achieved in the pump chambers. In contrast, during the discharge stroke the connection of the fluid chambers is interrupted, so that no pressure compensation can then take place, and the displacement devices execute the discharge stroke as if they were rigidly coupled to one another.

In another embodiment of the present invention, it is proposed that the pressure compensation be brought about by the displacement of arrestable pistons that are functionally connected and are exposed to the liquids that are to be pre-compressed. Preferably, for this purpose a compensating piston is used that is capable of being displaced in a housing and that divides the housing into two chambers and has two identical piston surfaces, each chamber being connected to one of the pump chambers. When there is a pressure difference between the pump chambers, the compensating piston moves, under the influence of the greater pressure, in the direction of the pump chamber having the lower pressure until the pressure difference is reduced to zero. In at least one of two lines between each pump chamber and its allocated chamber of the pressure compensation device, a shutoff device should be present that is open during the pre-compression phase for the purpose of pressure compensation between the pump chambers and is closed during the discharge stroke, so that the displacement devices carry out the discharge stroke as if they were connected rigidly to one another. During the intake stroke, and while the shutoff device is simultaneously open, the compensating piston should be compelled to move to its center position by at least one centering spring, preferably by two centering springs. In this way, the entire pressure compensation capacity of the pressure-compensating device is available for the subsequent pre-compression phase. Instead of the one compensating piston acted on at two sides by the two liquids that are to be conveyed, it is also possible to use two compensating pistons acted on at one side by the liquids, and functionally connected to one another via a lever system.

According to an embodiment that is preferred in particular for cases in which the displacement devices have extremely different cross-sections, it is provided that during the pre-compression phase the displacement devices are driven independently of one another, and come to a standstill independently of one another when the desired pre-compression pressure is achieved, and are coupled to one another during the discharge stroke. In other words, therefore, the smaller-surface displacement device is to be rigidly coupled to the larger-surface displacement device during the discharge stroke. During the pre-compression phase, the smaller-surface displacement device should be capable of being displaced relative to the larger-surface displacement device, and should preferably produce, by a hydraulic cylinder having a corresponding size that is allocated thereto, approximately the same pre-compression pressure in the liquid enclosed in the associated pump chamber as is produced in the liquid in the pump chamber having the larger-surface displacement device.

Usefully, with the aid of a cylinder, preferably a pneumatic cylinder, it should be possible to bring the smaller-surface displacement device into a zero position during the intake stroke, from which position the full provided pressure compensation capacity is available in both directions for the following pre-compression phase.

In another preferred embodiment, the present invention proposes that the pre-compression be carried out by pre-compression displacement device that is capable of being arrested during the discharge stroke, is driven in a hydraulically decoupled manner, is allocated to the second displacement device and to all additional displacement devices of a pump side, and acts in each case on the same liquid that is to be discharged. Thus, differing from the embodiment indicated above, here instead of the one small-surface displacement device two displacement devices are to be used, each acting on the same quantity of liquid enclosed in the discharge cylinder. However, the one displacement device should be constantly coupled rigidly to the large-surface displacement device and should take over the liquid discharge function, while the other, smaller-surface displacement device takes over the pressure compensation during the pre-compression phase. This additional small-surface displacement device should therefore be capable of displacement relative to the other small-surface displacement device, and should be connected to a cylinder, preferably a hydraulic cylinder, of a corresponding size, that produces in the enclosed liquid approximately the same pre-compression pressure as is produced in the pump chamber having the large-surface displacement device. During the discharge stroke, the displaceability of this additional small-surface displacement device should be disabled, e.g. by closing a stop valve situated in a hydraulic line to the associated hydraulic cylinder.

In this variant as well, during the intake stroke the additional small-surface displacement device should usefully be brought into a zero position, from which position the full provided capability of movement in both directions is available for the following pre-compression phase.

The solution of the second part of the problem is achieved according to the present invention by a reciprocating positive displacement pump of the type cited above that is characterized by means that effect a pressure compensation between the individual pump chambers during the pre-compression phase, and that prevent a pressure compensation between the individual pump chambers during the subsequent discharge stroke.

BRIEF DESCRIPTION OF THE DRAWINGS

In the following, exemplary embodiments of the present invention are explained on the basis of a drawing.

DETAILED DESCRIPTION OF THE PREFERRED EMBODIMENTS

All positive displacement pumps shown as examples are used for the pulsation-free discharge, which is constant and uniform with respect to the discharged quantity ratio, of two liquids 10 and 11 by the positive displacement pump, from respectively allocated supply reservoirs 10' and 11' via intake lines 10" and 11" to a consumer (not shown) to which discharge lines 19 and 19' lead that are connected after the positive displacement pump.

Liquids 10 and 11 can for example be the two components of a two-component coating material for roadway markings, in which case the consumer is then for example an application nozzle or a comparable device for applying the coating material onto a roadway that is to be marked.

In the following, only the process of the building up of identical pre-compression pressure in the two pump chambers 1 and 2 of the first pump part (shown at left in FIGS. 1 to 3 and 7) will be considered; in the other, second pump part (shown at the right in the named Figures) the same process takes place identically, in push-pull fashion relative to the process in the first pump part.

Figure 1:
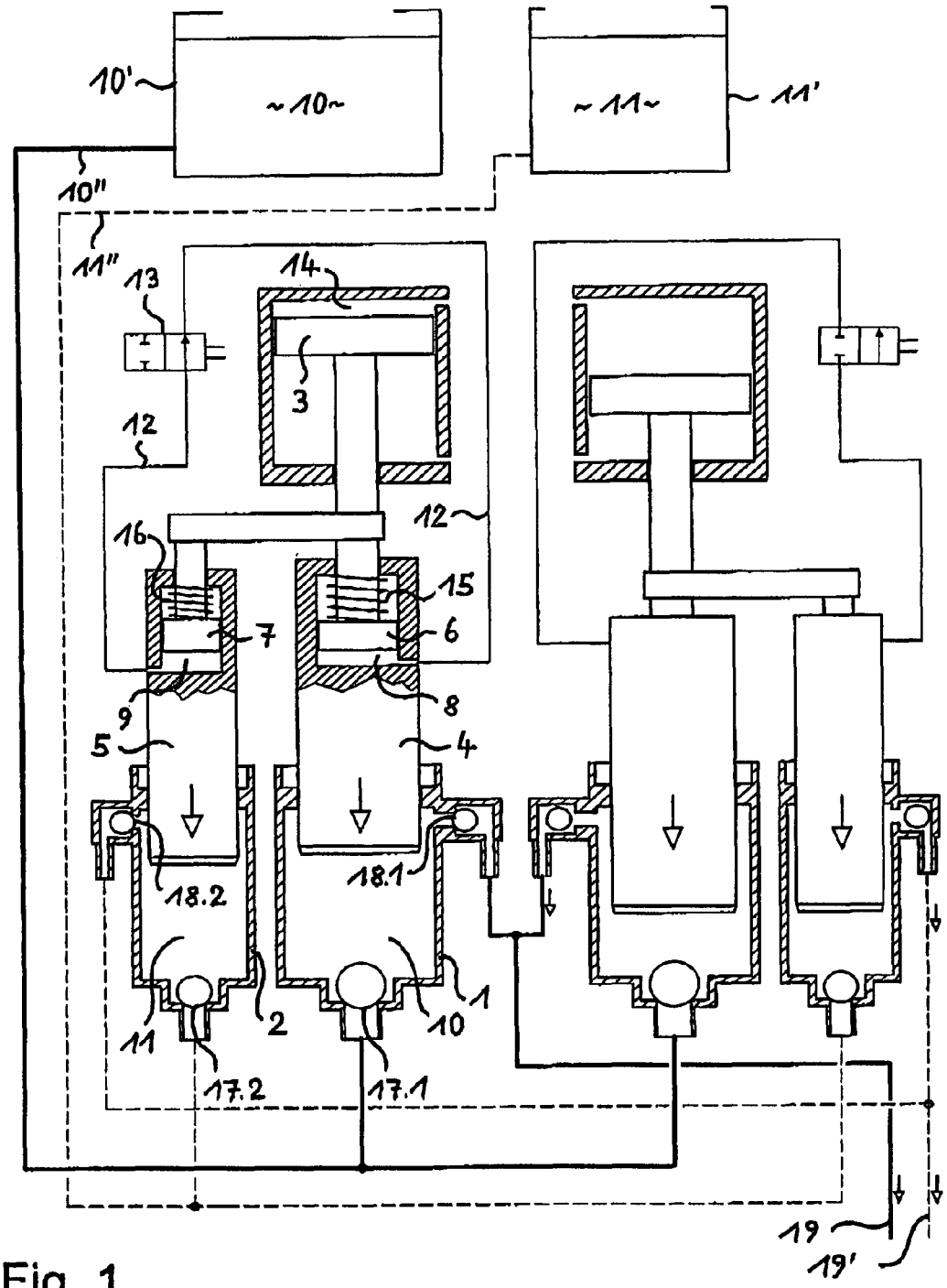
FIG. 1 shows a reciprocating positive displacement pump in a first embodiment, in which two additional hydraulic pistons connected rigidly to a hydraulic drive piston transmit their force to displacement devices via an enclosed fluid.

In the example according to FIG. 1, the force of a drive piston 3, here a hydraulic piston, is transmitted via two pistons 6 and 7, via a fluid (here hydraulic oil) enclosed in two fluid chambers 8 and 9, and via two displacement devices 4 and 5, to two liquids 10 and 11 enclosed in pump chambers 1 and 2. Fluid chambers 8 and 9 are connected by a line 12 in which there is situated a stop valve 13.

If, given a backwards movement for example of displacement device 4 in pump chamber 1, e.g. due to better pump chamber filling, the pressure increases in pump chamber 1 faster than in the other pump chamber 2, then the pressure in the corresponding fluid chamber 8 also increases, and fluid is pressed via line 12 and opened stop valve 13 into fluid chamber 9 of the other displacement device 5. Displacement device 4 therefore remains in its backwards movement while displacement device 5 is accelerated until approximately the same pressure, dependent on the hydraulic oil pressure regulated by a regulating device (not shown) in a drive cylinder chamber 14 of drive piston 3, has established itself.

Before the beginning of a subsequent discharge stroke, stop valve 13 is closed, and a displacement of fluid between fluid chambers 8 and 9 during the discharge stroke is therefore prevented.

Between each of the pistons 6, 7 and one of the pressure springs 15 and 16 allocated to displacement devices 4, 5, when stop valve 13 is open, during the intake stroke (upward stroke) displacement devices 4 and 5 move back into a central initial position relative to pistons 6 and 7, which position ensures the complete capability of movement upward and downward for the following pre-compression phase. However, when the displacement devices are displaced from their initial position relative to pistons 6 and 7, the pressure springs cause a slight inequality of the pressures in liquids 10 and 11. This is because one of the springs is always shortened slightly, causing a pressure increase in the corresponding discharge medium, while the other spring is lengthened, causing a reduction in pressure in the other discharge medium. However, these differences do not disturb the functioning of the pump.

Figure 2:
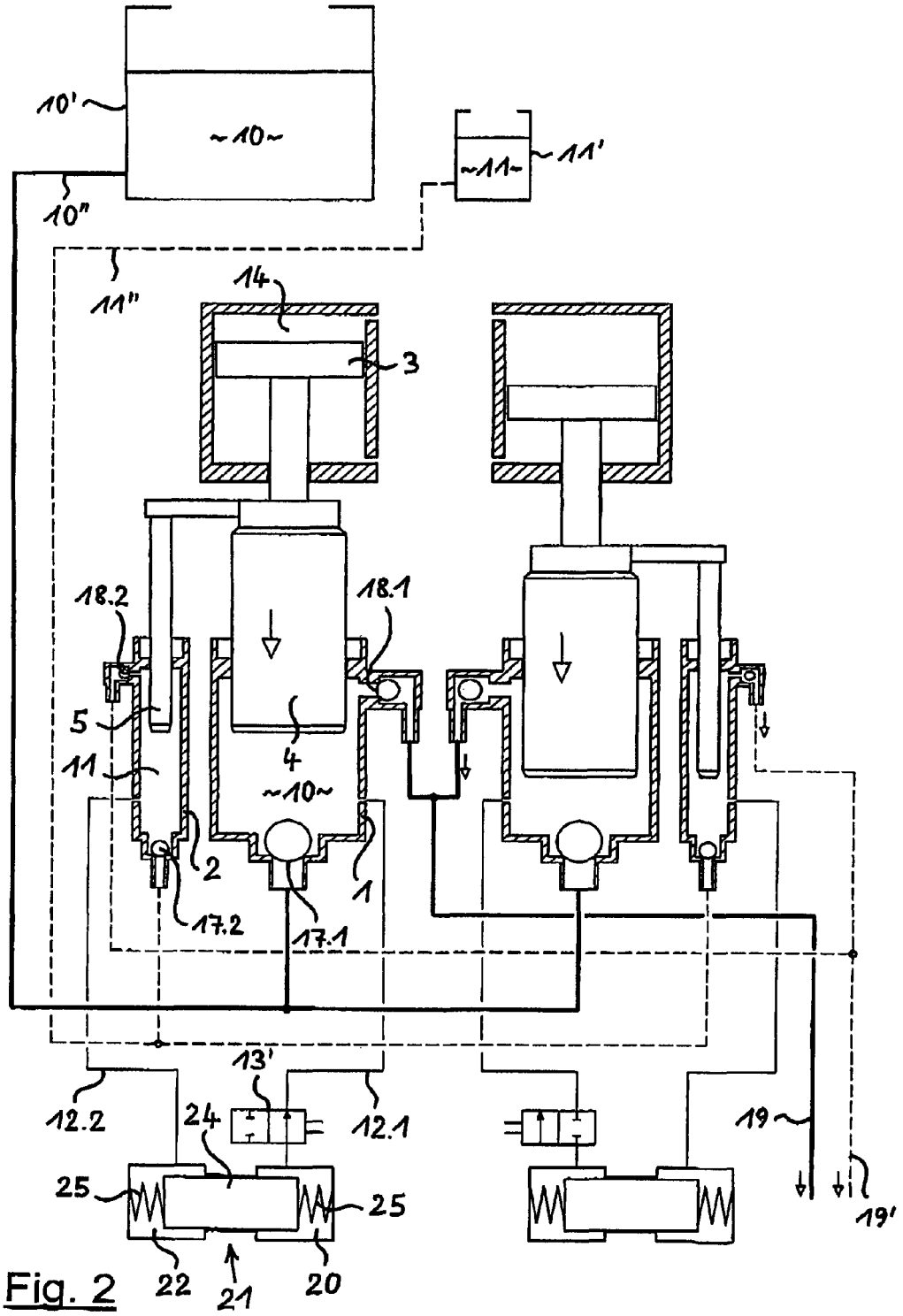
FIG. 2 shows the positive displacement pump in an embodiment having a pressure compensation device that is acted on by the liquids enclosed in two pump chambers.

In the embodiment according to FIG. 2, displacement devices 4 and 5 are connected rigidly to drive piston 3, and execute the axial movements in common, without displacement relative to one another. First pump chamber 1 is connected to a first chamber 20, and second pump chamber 2 is connected to a second chamber 22, of a pressure compensation device 21, via lines 12.1 and 12.2 respectively. Pressure compensation device 21 has a displaceable compensating piston 24 that extends into oppositely situated chambers 20 and 22. A stop valve 13' is installed in one of lines 12.1, 12.2 (here in line 12.1).

If, given a backward movement of displacement devices 4 and 5, the pressure for example in first pump chamber 1 increases faster than in second pump chamber 2 due to a higher degree of filling, then, given a now opened stop valve 13', compensating piston 24 moves toward the chamber 22 having the lower pressure (here into chamber 22) due to the higher pressure that also arises in chamber 20, until approximately the same pressure, determined by the pressure in drive cylinder chamber 14 of drive piston 3, has established itself in both chambers 20 and 22, and in both pump chambers 1 and 2 connected thereto.

Before the beginning of the subsequent discharge stroke, stop valve 13' is closed, thus preventing a further displacement of the liquids in pressure compensation device 21.

Compensating piston 21 is held between two axially acting pressure springs 25 that, given an opened stop valve 13', guide compensating piston 21 back to its center position during the intake stroke, said position ensuring the complete provided capability of movement in both directions for the following pre-compression phase. The same holds for the influence of springs 25 on the liquid pressures, as was stated above in relation to FIG. 1.

In the example according to FIGS. 3 to 6, only first displacement device 4 is connected rigidly to drive piston 3, while second displacement device 5 is capable of being displaced relative to displacement device 4. The pressure from drive cylinder chamber 14 acts via a line 12", in which a stop valve 13" is situated, in a cylinder 42 connected rigidly to drive piston 3, on a piston 43 allocated to second displacement device 5.

The ratio of the effective surface of piston 43 to the effective surface of second displacement device 5 corresponds to the surface ratio of drive piston 3 and displacement device 4.

Under the influence of the pressure prevailing in drive cylinder chamber 14, when stop valve 13" is open the same pre-compression pressures arise in both pump chambers 1 and 2 even given different degrees of filling, as a result of the displaceability relative to one another of drive piston 3 and piston 43.

Figure 3:
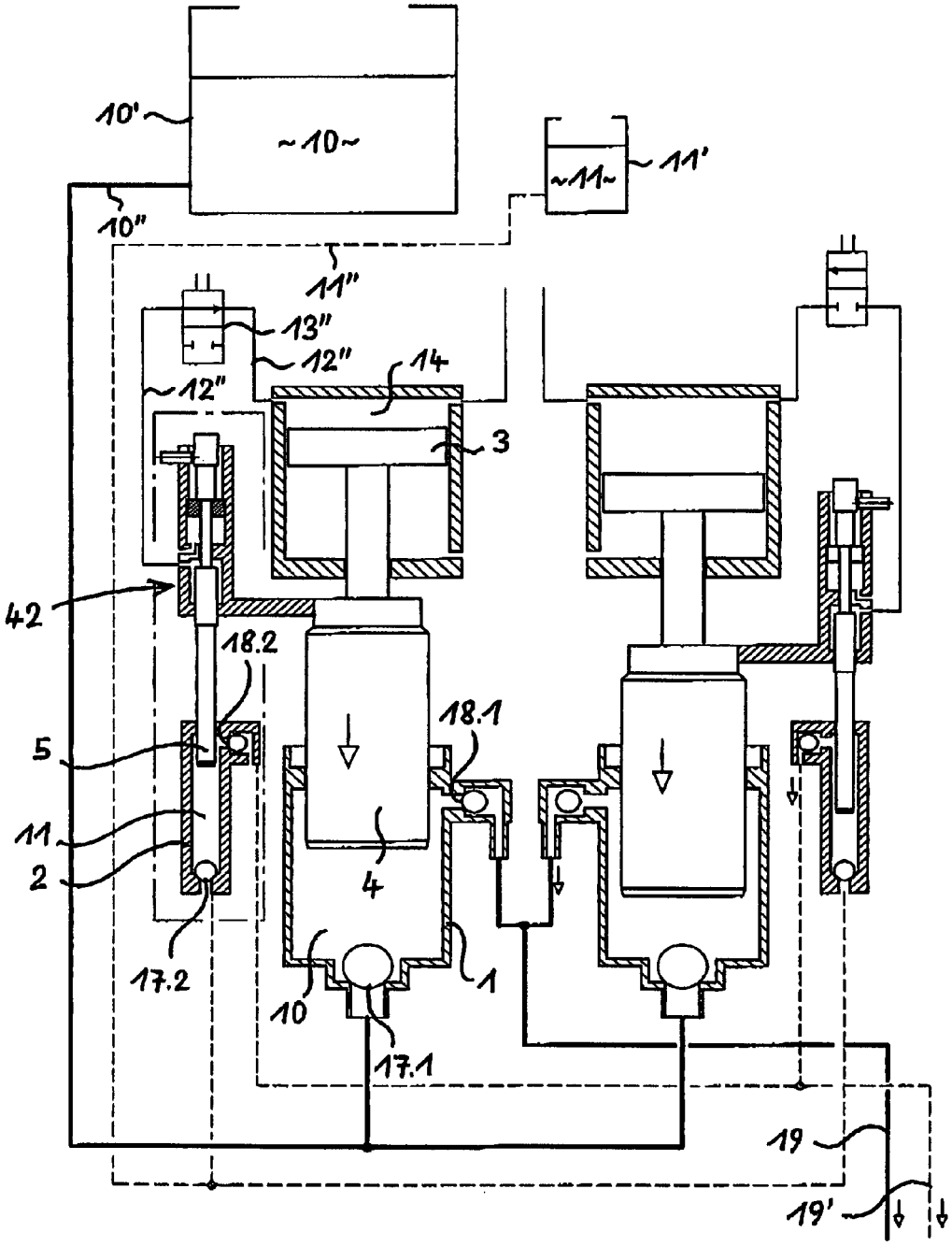
FIG. 3 shows the positive displacement pump in an embodiment in which during a pre-compression phase both displacement devices of each pump side bring the liquids enclosed in the pump chambers to pre-compression pressure independently of one another, FIGS. 4 to 6 each show a segment from FIG. 3 with the pump part having the smaller-surface displacement device in various positions.
Figure 4:
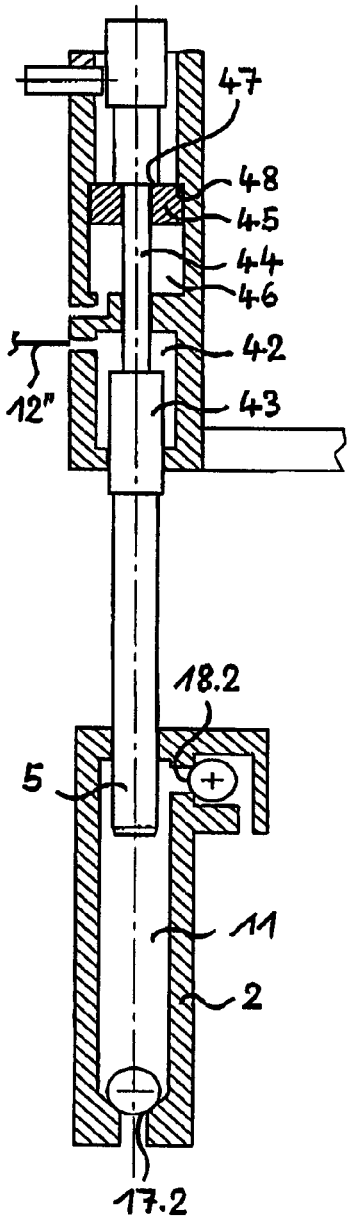

FIG. 4 shows a segment from FIG. 3 with small-surface displacement device 5, in which this displacement device 5 is shown in its initial position relative to displacement device 4, in which it has the full provided movement capability upward and downward relative to displacement device 4.

Figure 5:
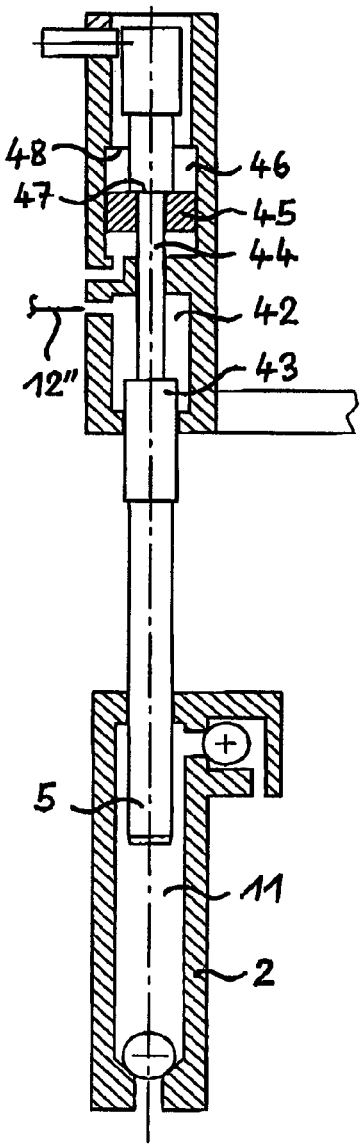

If, at the beginning of the pre-compression phase, second pump chamber 2 has a degree of filling less than that of first pump chamber 1, then second displacement device 5 moves until the desired pre-compression pressure is achieved in a position that is advanced, i.e. here displaced downward, relative to first displacement device 4, said position being shown in FIG. 5, which shows the same segment as FIG. 4. The magnitude of the relative displacement is dependent on the size of the difference in the degree of filling in pump chambers 1 and 2.

Figure 6:
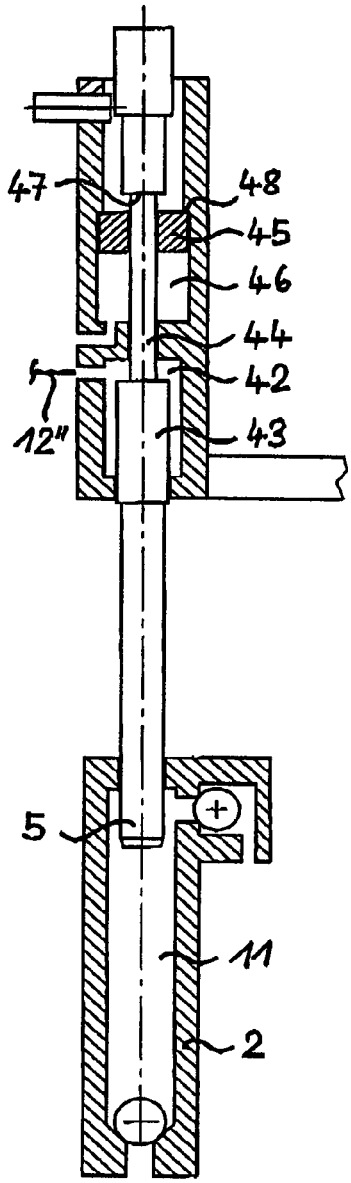

If, in contrast, the degree of filling in second pump chamber 2 is greater than in first chamber 1, then second displacement device 5 moves into a position that is retarded, i.e., here displaced upward, relative to first displacement device 4, said position being shown in FIG. 6, which shows the same segment as FIG. 4.

On its side facing away from displacement device 5, piston 43 has a piston rod 44 that is led out from the cylinder chamber of cylinder 42 and is led through a subsequent cylinder chamber 46. A piston 45 that is capable of axial displacement is situated on piston rod 44. On the side facing away from displacement device 5, piston rod 44 has an enlargement in its diameter that forms a collar 47. In addition, on the side facing away from displacement device 5 cylinder chamber 46 has a taper that forms a collar 48.

The initial position of displacement device 5 according to FIG. 4, in which displacement device 5 has the provided capability of movement in both directions, is defined in that piston 45 is adjacent to collar 48 of cylinder chamber 46 and piston rod collar 47 is adjacent to piston 45.

If, during the pre-compression phase, displacement device 5 moves out of the initial position into a position that is displaced downward relative to displacement device 4, piston 45 is carried along in the same direction by piston rod collar 47. Through the pressure charging of cylinder chamber 46 during the intake stroke of the two displacement devices 4 and 5, piston 45 and (via collar 47) displacement device 5 are guided upward back into the initial position.

If, in contrast, during the pre-compression phase displacement device 5 moves out of the initial position relative to displacement device 4 into a position that is displaced upwardly, piston rod 44 moves through piston 45 adjacent to cylinder collar 48, so that piston rod collar 47 moves away from piston 45. During the intake stroke, displacement device 5 is guided back by the downward-directed frictional force at the sealing point of pump chamber 2 and by a slight remaining hydraulic pressure in the cylinder chamber of cylinder 42 until piston rod collar 47 on piston 45, which is pressed against cylinder collar 48 in pressure-charged cylinder chamber 46, comes to be seated and thus again assumes its initial position.

During the discharge stroke, stop valve 13' is closed, so that as a result a displacement of displacement device 5 relative to displacement device 4 is no longer possible, so that both displacement devices 4 and 5 execute the discharge stroke as if they were connected rigidly to one another.

In the example according to FIGS. 7 to 10, the functions "discharge" and "pre-compression pressure buildup" are divided between two displacement devices 5 and 51. A second, smaller-surface displacement device 5 that is connected rigidly to the first, larger-surface displacement device 4 takes over the liquid discharge; the other, freely movable displacement device 51 takes over the buildup of the pre-compression pressure. The other displacement device 51 and its actuating device are not allocated to large-surface displacement device 4, as is the case in the embodiment according to FIGS. 4 to 7; rather, they are allocated to second pump chamber 2. Displacement devices 4 and 5, rigidly connected to one another, can be displaced via common drive piston 3. Drive cylinder chamber 14, situated above drive piston 3, is connected, via a hydraulic line 12''' having a stop valve 13''' situated therein, to a cylinder chamber 53 for a displacement of additional displacement device 51.

Figure 7:
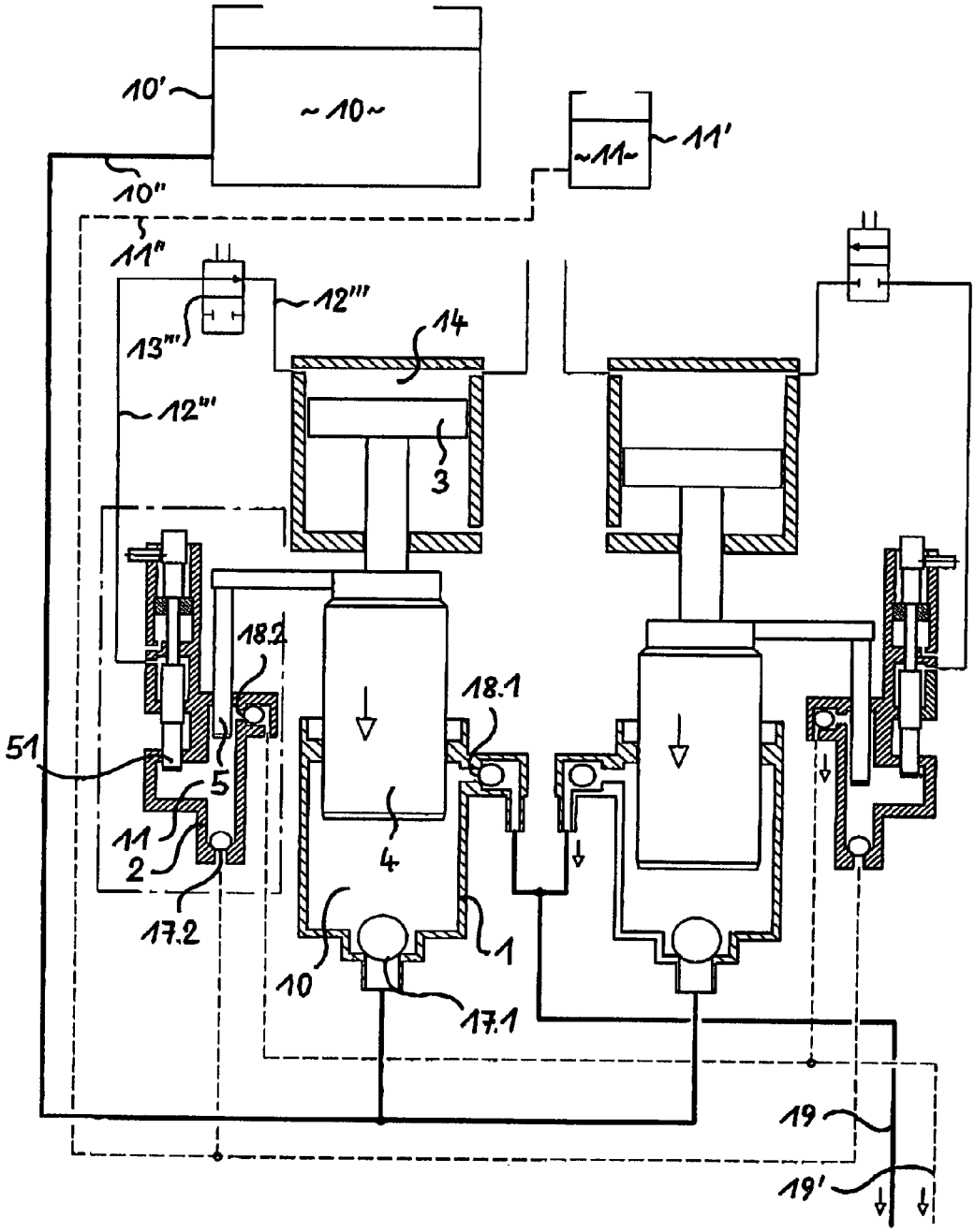
FIG. 7 shows the positive displacement pump in an embodiment in which during the pre-compression phase the one liquid is brought to pre-compression pressure by its associated displacement device, and the other liquid is brought to pre-compression pressure by an additional displacement device that is not entrained with a discharge stroke and that is provided separately for a pre-compression, and FIGS. 8 to 10 each show a segment from FIG. 7, with the pump part having the smaller-surface displacement device in various positions.
Figure 8:
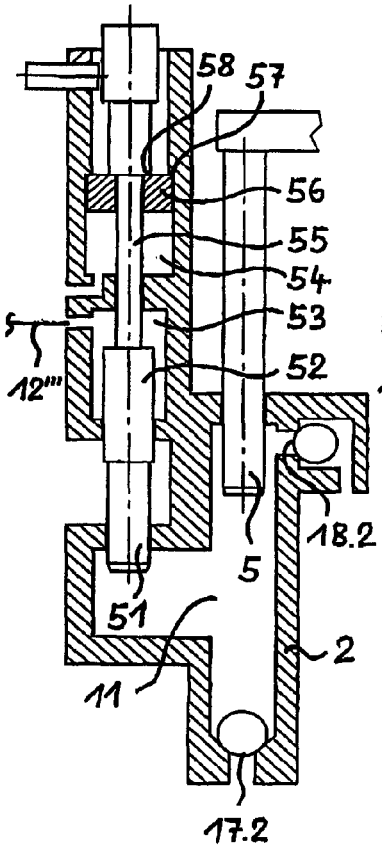

FIG. 8 shows a segment with smaller-surface displacement device 5 from FIG. 7, with additional displacement device 51 in its initial position, in which it has the complete provided capability of movement upward and downward for the compensation of differences in the degrees of filling in pump chambers 1 and 2. The operating principle of the actuating device corresponds to the operating principle of the actuating device according to FIG. 4.

Figure 9:
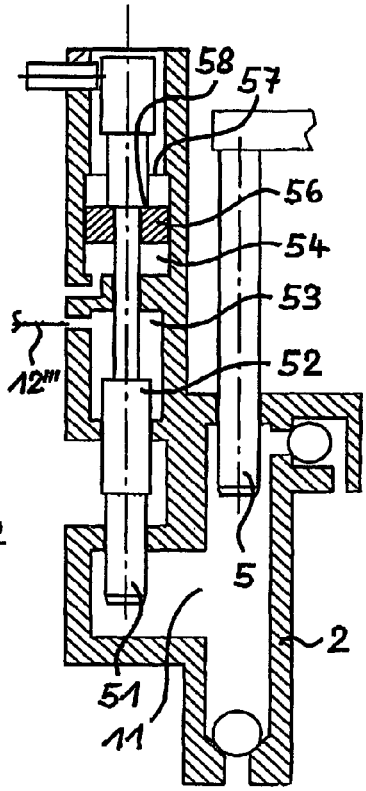

If, at the beginning of the pre-compression phase, second pump chamber 2 has a degree of filling that is less than that of first pump chamber 1, then the additional displacement device 51 moves into a position below the initial position, as is shown in FIG. 9. The magnitude of the displacement is dependent on the size of the difference in the degree of filling.

Figure 10:
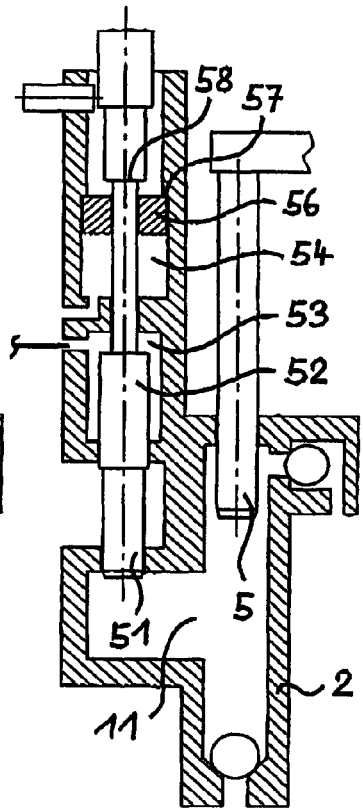

If, in contrast, the degree of filling in second pump chamber 2 is greater than in first pump chamber 1, then additional displacement device 51 moves into a position (shown in FIG. 10) above the initial position, as can be seen in FIG. 10.

A hydraulic piston 52, connected fixedly to additional displacement device 51, has on its side facing away from displacement device 51 a piston rod 55 that is led out from the associated cylinder chamber 53 and is led through a subsequent cylinder chamber 54. A piston 56 capable of axial displacement is situated on piston rod 55. On the side facing away from additional displacement device 51, piston rod 55 has an enlargement in its diameter that forms a collar 58. In addition, on its side facing away from additional displacement device 51, cylinder chamber 54 has a taper that forms a collar 57.

The initial position of additional displacement device 51, as is shown in FIG. 8 and in which additional displacement device 51 has the complete provided capability of movement in both directions, is defined in that piston 56 is adjacent to collar 57 of cylinder chamber 54 and piston rod collar 58 is adjacent to piston 56.

When there is a displacement of additional displacement device 51 during the pre-compression phase into a position below the initial position, piston 56 is carried along in the same direction by piston rod collar 58. Through pressure charging of cylinder chamber 54 during the intake stroke of displacement devices 4 and 5, piston 56 and, via collar 58, additional displacement device 51 are guided upward back into the initial position.

When there is a displacement of additional displacement device 51 into a position above the initial position, piston rod 55 moves through piston 56 adjacent to cylinder collar 57, so that piston rod collar 58 moves away from piston 56. During the intake stroke of displacement devices 4 and 5, additional displacement device 51 is guided back by a slight remaining hydraulic pressure in cylinder chamber 53 until piston rod collar 58 on piston 56, which is pressed against cylinder collar 57 in pressure-charged cylinder chamber 54, comes to be seated and thus again assumes its initial position.

During the discharge stroke of displacement devices 4 and 5, stop valve 13''' is closed, so that a displacement of additional displacement device 51 is no longer possible.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

LIST OF REFERENCE CHARACTERS

1 first pump chamber
2 second pump chamber
3 drive piston
4 first displacement device
5 second displacement device
6 first piston
7 second piston
8 first fluid chamber
9 second fluid chamber
10 first liquid to be discharged
10' supply reservoir for 10
10" intake line for 10
11 second liquid to be discharged
11' supply reservoir for 11
11" intake line for 11
12 line between 8 and 9
12" line between 14 and 42
12" line between 14 and 53
12.1 line between 1 and 20
12.2 line between 2 and 22
13-13''' stop valves
14 drive cylinder chamber
15 spring in 4
16 spring in 5
17.1, 17.2 suction valves
18.1, 18.2 outlet valves
19, 19' discharge lines
20 first chamber in 21
21 pressure compensation device
22 second chamber in 21
24 compensating piston between 20 and 22
25 springs in 20 and 22
42 hydraulic cylinder
43 hydraulic piston
44 piston rod
45 displaceable piston
46 cylinder chamber
47 collar on 44
48 collar on 46
51 additional displacement device
52 hydraulic piston
53 cylinder chamber
54 cylinder chamber
55 piston rod
56 displaceable piston
57 collar in 54
58 collar on 55

The invention claimed is:

1. A method for operating a reciprocating positive displacement pump for the simultaneous low-pulsation discharge of a plurality of liquids, having for a first liquid a first and second pump chamber and for a second liquid having different properties than the first liquid a third and fourth pump chamber and respective displacement devices capable of movement within each of the pump chambers, of which the first and third displacement devices take in liquid during the actual discharge phase of the second and fourth displacement devices and at the end of their intake stroke reverses their direction of movement, and, in a pre-compression phase, the first and third displacement devices pre-compress the liquid taken into their associated pump chambers and when a predeterminable pre-compression pressure has been achieved, come to a standstill, and remain at the standstill until the second and fourth displacement devices have ended their liquid discharge, and, subsequent to this discharge, begin their own discharge, wherein during the pre-compression phase of the first and third pump chambers, and alternately of the second and fourth pump chambers, a pressure compensation is carried out between the first and third, and alternately second and fourth, pump chambers and during the subsequent discharge stroke a pressure compensation between the first and third, and alternately the second and fourth, pump chambers is prevented.

2. The method as recited in claim 1, wherein for each liquid that is to be discharged there are individual pistons present that are rigidly connected to a single drive piston to transmit their force via a fluid to the displacement devices, each displacement device being allocated to one of the pistons, so that fluid chambers between the individual pistons and the first and third, and alternately the second and fourth, displacement devices are connected to one another during the pre-compression phase and are decoupled from one another during the discharge stroke.

3. The method as recited in claim 1, wherein the pressure compensation is effected by the displacement of arrestable pistons that are functionally connected and that are exposed to the liquids that are to be pre-compressed.

4. The method as recited in claim 1, wherein during the pre-compression phase the first and third, and alternately the second and fourth, displacement devices are operated independently of one another, and come to a standstill independently of one another when the desired pre-compression pressure is achieved, and are coupled to one another during the discharge stroke.

5. The method as recited in claim 1, wherein the pre-compression is carried out by pre-compression displacement devices that are allocated to the second and to each additional displacement device and that act on the same liquid that is to be discharged, and that are driven in a hydraulically decoupled manner, and that are capable of being arrested during the discharge stroke.

6. A reciprocating positive displacement pump for the simultaneous low-pulsation discharge of a plurality of liquids, comprising:

at least a first and a second pump chamber for a first liquid and at least a third and a fourth pump chamber for a second liquid, the first liquid and second liquid having different properties from each other, each of the pump chambers having a corresponding displacement device capable of movement therein, for the first and second pump chambers associated with the first liquid, and for the third and fourth pump chambers associated with the second liquid:

displacement devices in the first and third pump chambers take in liquid during an actual discharge phase of the displacement devices of the second and fourth pump chambers and at the end of their intake stroke reverse their direction of movement, in a pre-compression phase, the displacement devices in the first and third pump chambers pre-compress the liquid taken into the first and third pump chambers and, when a predeterminable pre-compression pressure has been achieved, come to a standstill, and remain at the standstill until the displacement devices in the second and fourth pump chambers have ended their liquid discharge, and, subsequent to this discharge by the second and fourth displacement devices, the first and third displacement devices begin their own discharge, and a first pressure compensation device attached to the first and third pump chambers and a second pressure compensation device attached to the second and fourth pump chambers, and arranged such that during their respective pre-compression phases pressures are compensated in the first and third pump chambers and in the second and fourth pump chambers and that during their subsequent discharge stroke pressure compensation between the first and third pump chambers and alternately between the second and fourth pump chambers is prevented.

7. The positive displacement pump as recited in claim 6, wherein for each liquid that is to be discharged, there are individual pistons provided that are rigidly coupled to one another, whose force is capable of being transmitted via a fluid to one of the allocated displacement devices and wherein between the individual pistons and the first and third, and alternately the second and fourth, displacement devices, fluid chambers are provided that are arranged to be connected to one another for the pre-compression and are arranged to be decoupled from one another for the discharge stroke.

8. The positive displacement pump as recited in claim 6, wherein functionally connected pistons that are exposed to the liquids that are to be pre-compressed are provided that are arranged to be released and displaced relative to one another in order to enable the pressure compensation, and are arranged to be arrested relative to one another in order to prevent a pressure compensation.

9. The positive displacement pump as recited in claim 6, wherein during the pre-compression phase the first and third, and alternately the second and fourth, displacement devices are arranged to be driven independently of one another, and come to a standstill independently of one another when the desired pre-compression pressure has been achieved, and are arranged to be coupled to one another for the discharge stroke.

10. The positive displacement pump as recited in claim 6, wherein the first and third displacement devices on one pump side and alternately the second and fourth displacement devices on another pump side, are rigidly coupled to one another, and wherein a pre-compression displacement device is allocated to the third displacement device on the one pump side, and a pre-compression displacement device is allocated to the fourth displacement device on the another pump side, each pre-compression displacement device acting on the same liquid that is to be discharged as its allocated displacement device, and each pre-compression displacement device being arranged to be driven in a hydraulically decoupled manner for the pre-compression, and each pre-compression displacement device being arranged to be held against displacement for the discharge stroke.

11. The positive displacement pump as recited in claim 6, wherein the first and third, and alternately the second and fourth, displacement devices are rigidly coupled to one another, and wherein between the first and third, and alternately the second and fourth, pump chambers a pressure compensation device is provided that has two chambers, each compensation device chamber connected to one of the first or third, and alternately the second or fourth, pump chambers and having a compensating piston that is situated between the compensation device chambers and that is arranged to be displaced back and forth, at least one of the connections between the pump chambers on the one hand and the chambers of the pressure compensation device on the other hand being arranged to be released and blocked optionally by means of a valve.

12. The positive displacement pump as recited in claim 7, wherein the fluid is a hydraulic oil, and wherein the connection between the fluid chambers is formed by a hydraulic oil line having a valve situated therein.

13. The positive displacement pump as recited in claim 12, wherein a spring is situated between each piston and its respectively associated displacement device, with which a force can be exerted on the associated piston that brings the piston into a defined initial position when the valve is open.

14. The positive displacement pump as recited in claim 11, wherein in at least one of the chambers of the pressure compensation device there is situated a spring with which a force can be exerted on the compensating piston that brings this piston into a defined initial position when the valve is open.

15. The positive displacement pump as recited in claim 6, comprising a discharge and dosing pump of a device for creating roadway markings from a liquid, reaction-hardening, two-component coating material.

* * * * *